US005111956A

United States Patent [19]

Jow

[11] Patent Number: 5,111,956

[45] Date of Patent: May 12, 1992

[54] FOOD COVER FOR PROVIDING BOTH A FULL CLOSED POSITION AND A QUASI-OPEN, SNEEZE GUARD POSITION AND INCLUDING SIDE PANELS, A SEGMENTED HINGE AND MIRROR IMAGE FRONT AND BACK PANELS

[76] Inventor: Warren Jow, 5222 Gordon Ave., El Cerrito, Calif. 94530

[21] Appl. No.: 467,805

[22] Filed: Jan. 19, 1990

[51] Int. Cl.[5] ..... B65D 43/24

[52] U.S. Cl. ..... 220/338; 220/331; 220/335

[58] Field of Search ..... 220/331, 334, 335, 337, 220/338, 340, 342

[56] References Cited

U.S. PATENT DOCUMENTS

| | | | |
|---|---|---|---|
| 1,080,551 | 12/1913 | Hartwell | 220/335 X |
| 1,745,548 | 2/1930 | Lerner | 220/85 CH X |
| 2,040,191 | 5/1936 | Wanders | 220/342 X |
| 2,770,389 | 11/1956 | Drakoff | 220/336 X |
| 3,317,078 | 5/1967 | Gordon | 220/342 |
| 3,924,294 | 12/1975 | Thaler et al. | 220/340 X |
| 4,260,069 | 4/1981 | Juergens | 220/331 |

*Primary Examiner*—Stephen Marcus
*Assistant Examiner*—Nova Stucker
*Attorney, Agent, or Firm*—Robert Charles Hill

[57] ABSTRACT

An all-plastic food cover is described that includes mirror image front and back L-shaped panels. The L-shaped panels are cantilevered from a fixed central roof lateral by means of an articulated, segmented hinge. Since the roof lateral is integrally formed between and is a part of the upright side panels (forming an unitary subassembly) and inasmuch as the particular elements of the hinge are individually molded and then pressure mounted together by hand in segments, the invention can be easily assembled, disassembled and reassembled without tools.

The hinge is segmented and includes a pair of support members that are each Cee-shaped in cross section. The support members are open along their full elongated length to form coextensive front and back passageways that permit entry of enlarged lips of the L-shaped front and back panels therein. The orientation and design of the support members (they are complementary canted) and the shape of the lips (L-shaped), permit the front and back panels to be separately swingable about collinear axes coextensive of the roof lateral. Yet these panels can also be strongly locked in closed and quasi-open sneeze positions relative to a horizontal base surface, such as a table top. Further rotation of either panel coupled with rectilinear movement away from the supporting horizontal base, allows the user to completely remove such panel from the hinge.

12 Claims, 4 Drawing Sheets

FOOD COVER FOR PROVIDING BOTH A FULL CLOSED POSITION AND A QUASI-OPEN, SNEEZE GUARD POSITION AND INCLUDING SIDE PANELS, A SEGMENTED HINGE AND MIRROR IMAGE FRONT AND BACK PANELS

FIELD OF THE INVENTION

The present invention relates to food covers. More particularly, it relates to the design, formation and use of such covers in order to provide both a full closed working position and a quasi-open, fixed sneeze guard position relative to a food tray or the like.

BACKGROUND OF THE INVENTION

The proliferation of convenience stores has occured throughout the world. In addition to vending usual grocery items including beverages, such stores now sell fast foods including specialty foods stacked on flat food trays.

In order to satisfy health codes, the trays are usually provided with separate food covers. One such design I am familiar with uses two domes hinged together by a metal piano hinge across their tops.

The design has several drawbacks. In its full open (per dome) position, the moved dome rests atop the other stationary dome. Thus food of the first section of tray is exposed to germs. Such germs might result from air being expelled from the customer's mouth say by a sneeze or be from dirt or the like falling from his hands, clothes or the like.

In attaining the open position, the moving dome is pivoted by the user. But if the food is hot, both the customer and clerk's arms could be exposed to heat. Also the domes must be operated in sequence since the stationary dome is the anchor for movement of the other.

Additional, the piano hinge is attached by rivets or the like. Hence once assembled, disassembly of the cover for whatever purpose and re-assembly, is difficult.

While the prior art is replete with food covers, I am unaware of any design having the following advantages, in combination:

(i) that can be assembled from separate molded plastic elements at the use location without tools;

(ii) after assembly at the use location, that can provide protection of food both in a full closed position and in a quasi-open sneeze guard position, (iii) that yet still can provide easy and safe release of a portion of the cover as when the user needs to replenish the tray.

In this regard, I have reviewed U.S. Pat. Nos. 1,080,551; 2,770,389 and 4,723,693 which show split lid designs for ice chests, frying pans, shakers and the like. These covers have open positions that either are overcenter from any vertical plane through the hinge, or that vary as a function of thickness and type of plastic used to form the hinge. U.S. Pat. Nos. 1,745,548; 3,015,405; 4,005,798; 4,773,555 and RE 32,745 are likewise distinguishable in that for the most part, overcenter open positions attained by mechanical linkages are taught. An exception is U.S. Pat. No. 4,005,798 where the user physically lifts the cover from the pan and uses a slotted metal block attached to the side of the cover to position the cover in an almost vertical position. There is obviously no swingable hinge or motion guides of any type to aid the user.

SUMMARY OF THE INVENTION

In a preferred form, the present invention includes mirror image front and back L-shaped panels. The L-shaped panels are swingable supported from a fixed central roof lateral by means of an articulated, segmented plastic hinge. Since the roof lateral is integrally formed between and is a part of the upright side panels (forming an unitary subassembly) and inasmuch as the particular elements of the plastic hinge are individually molded and then pressure mounted together by hand in segments, the invention can be easily assembled, disassembled and reassembled without tools.

The plastic hinge is segmented and includes a pair of elongated support members that are each Cee-shaped in cross section. The support members each include a plurality of wall segments forming an elongated passageway along the entire length of the member that permits entry of an enlarged lip formed along an entire side of one of the L-shaped front and back panels into the interior of the support member. The orientation and design of the support members (they are complementary canted) and the shape of the enlarged lips of the front and back panels (L-shaped), permit the latter panels to be separately swingable about collinear axes coextensive of the roof lateral. Yet these panels can also be strongly locked in closed and quasi-open sneeze positions relative to a horizontal base surface, such as a table top. Further rotation of either panel coupled with rectilinear movement away from the supporting horizontal base, allows the user to completely remove such panel from the hinge.

Assembly at the use site includes positioning elements of the hinge in close proximity of the user. Such elements include a spacer bar member that is the same length as the first and second support members. The spacer bar member is a parallelepipedon and includes oppositely canted side walls. Then the support members and spacer bar are inserted between the keeper skirts of the roof lateral integrally attached to side panels. The spacer bar member is centrally positioned relative to the support members and skirt keepers, and has canted side walls that snugly contact like oriented walls of with the support members. The result is the segmented hinge of the invention. Enlarged lips of the front and back panels are inserted into the slots at the interior of the support members to complete assembly. Disassembly is the reverse of the above steps. All assembly steps occur without the need for tools.

DETAILED DESCRIPTION OF THE INVENTION

Figure 1:
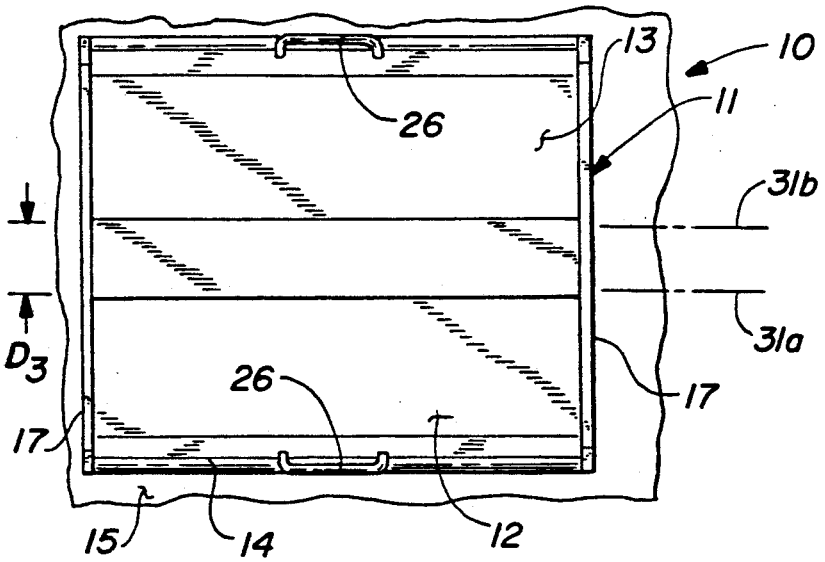
FIG. 1 is a plan view of the food cover of the present invention illustrating a fixed side panel-roof subassembly in which the roof lateral is integrally formed with respect to upright, fixed side panels.

FIG. 1 is a plan view of the food cover 10 of the present invention. The cover 10 includes molded side panel-roof subassembly 11 and L-shaped front and back panels 12 and 13. The cover 10 also has bottom edges 14. The edges 14 are in contact with a horizontal base such as table top 15.

Figure 2:
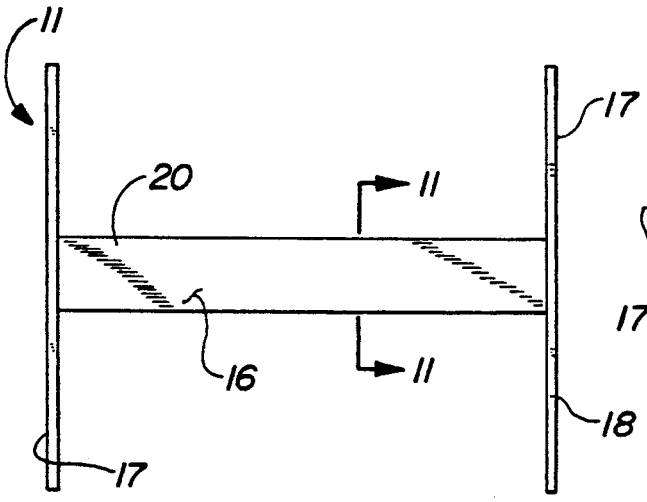
FIGS. 2 and 3 are plan and partial sectional views, respectively of side panel-roof subassembly of FIG. 1.
Figure 3:
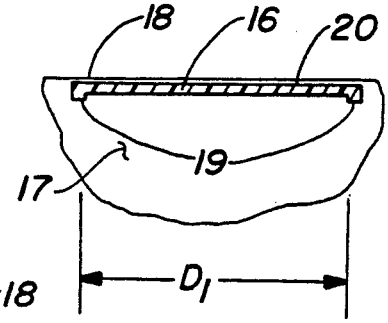

As shown in FIGS. 2 and 3, the subassembly 11 is unitary and is preferably formed using a mold to cure plastic material injected within the mold. It is composed of the following: (i) roof lateral 16 and (ii) side panels 17 integrally to (i) near upper surface 18. The roof lateral 16 is also provided with downwardly concave L-shaped keeper skirts 19 that extend from horizontal surface 20. The skirts 19 are separated by a distance D1.

Figure 5:
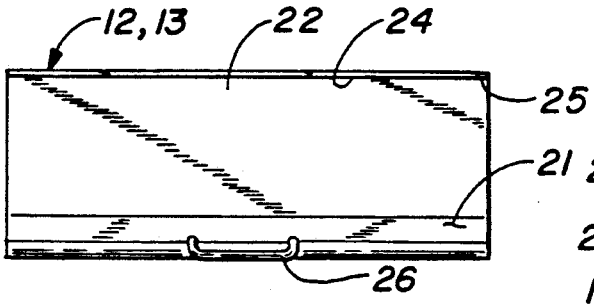
FIGS. 4 and 5 are plan and side views, respectively, of one of the front/back panels of FIG. 1.
Figure 4:
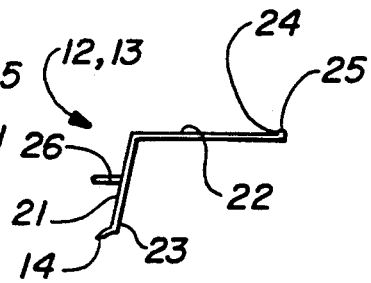

On the other hand as shown in FIGS. 4 and 5, the front and back panels 12, 13 are each of unitary design and can be formed also using a mold. Each panel 12, 13 comprises a canted segment 21 attached to a horizontal segment 22. Note that since the panels 12, 13 are mirror images of one another, a description of one suffices for the other. The edges 14 of the segment 21 are also slightly flared over region 23. The horizontal segment 22 is likewise bent at 24 to form an enlarged lip 25 at a right angle to the horizontal segment 22. A handle 26 is attach to the vertical segment 21 of each panel as by screws, not shown.

Figure 7:
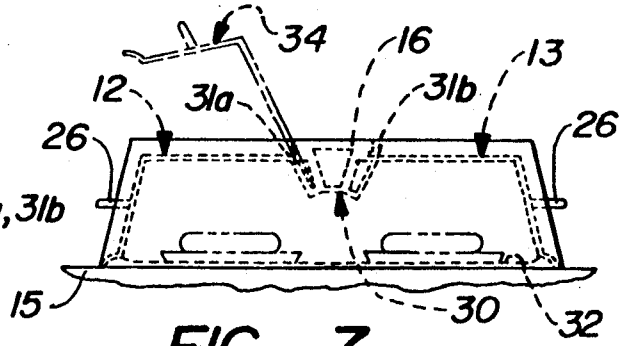
FIG. 7 is a side view of the food cover of FIG. 6.
Figure 6:
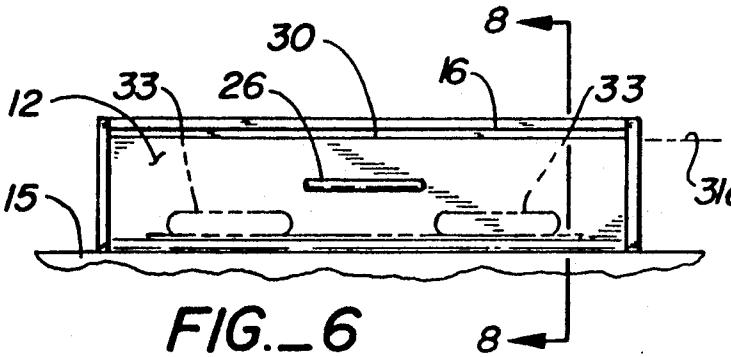
FIG. 6 is a front view of the food cover of the invention showing a segmented plastic hinge cantilevered from the fixed lateral of the subassembly of FIGS. 2 and 3 and supporting L-shaped front and back swingable panels of FIGS. 4 and 5 therefrom.

FIGS. 6 and 7 illustrate that the front and back panels 12, 13 are swingably attached to roof lateral 16 via a segmented hinge 30 in the manner explained below. The panels 12, 13 are thus easily swingable around pivot axes 31*a*, 31*b* of the hinge 30 by gripping a respective handle 26 and swinging the panels 12, 13 upwardly from the table top 15. The pivot axes 31*a*, 31*b* are also seen to be coextensive of the roof lateral 16.

As shown, the panels 12, 13 are supported on the table top 15 and protect flat food tray 32 and pastries 33 shown in phantom line. In FIG. 7, the two operating positions of the panels 12, 13 are shown. The closed position is more clearly shown in solid line in FIG. 6. The quasi-open, sneeze guard position is shown in phantom line in FIG. 7, viz., at numeral 34.

Figure 8:
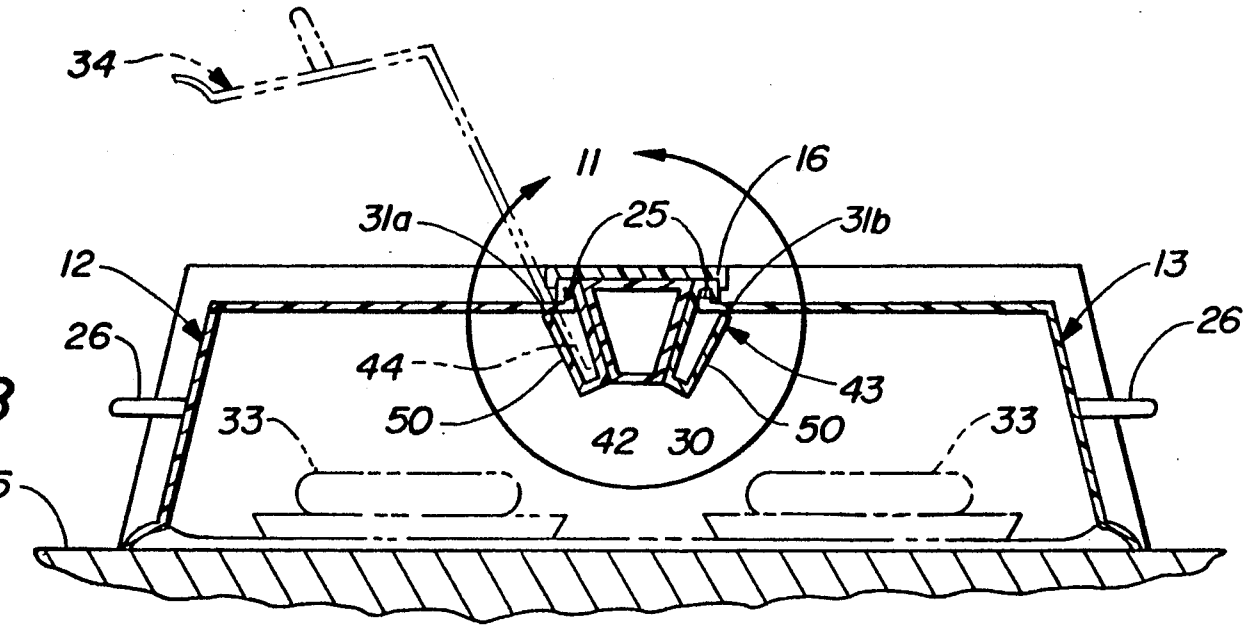
FIG. 8 is a section taken along line 8—8 of FIG. 6 illustrating how the front and back panels operationally attached to the segmented plastic hinge.

FIG. 8 illustrates hinge 30 of the invention in more detail.

The plastic hinge 30 is segmented and includes a pair of support members 42, 43 that are each Cee-shaped in cross section. The support members 42, 43 are open along their elongated length. As a result, coextensive front and back passageways 44, 45 are formed. They are designed to permit entry of enlarged lips 25 of the L-shaped front and back panels 12, 13 into the interior of the members 42, 43. Briefly in accordance with the invention, the orientation of the support members 42, 43 (they are complementarily canted) as well as the upright shape of the lips 25 of the panels 12, 13, permit the panels 12, 13 to be separately operatable. I.e., the user can pivot the panels 12, 13 about either of the pivot axes 31*a*, 31*b* as required before final positions as set forth are attained. Yet the panels 12, 13 can then be strongly locked in closed and quasi-open sneeze positions relative to a horizontal base surface, such as the table top 15. Further rotation of either panel 12, 13 coupled with rectilinear movement away from the table top 15, allows the user to completely remove such panel 12 or 13 from the hinge 30. Still further, the shape of the members 42, 43 and the canted orientation of the more flexible cantilevered wall segment 50 of each member 42, 43 also aids in the proper guidance of the front and back panels 12, 13 during many of the above mentioned operations.

Figure 11:
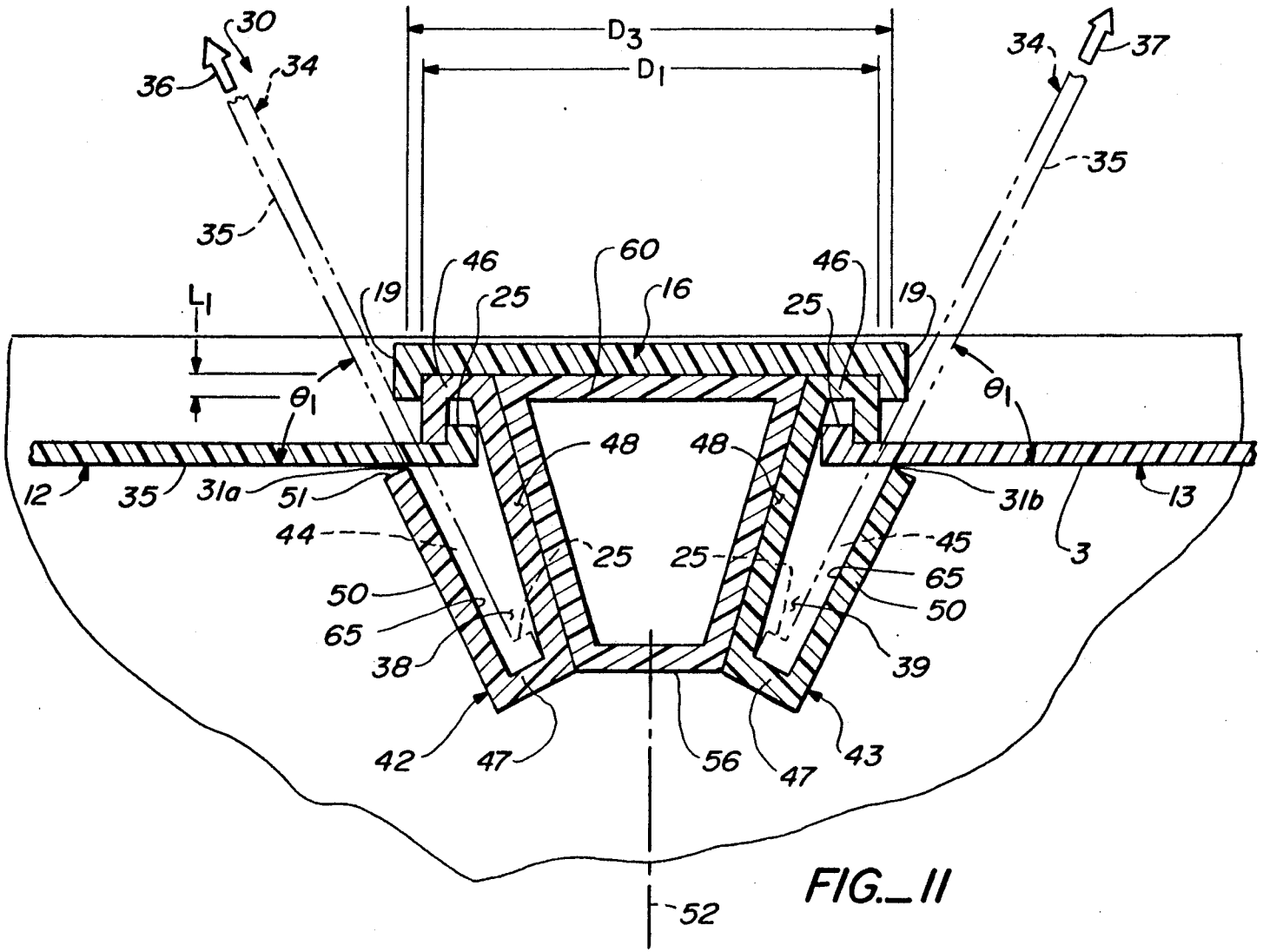
FIG. 11 is an enlarged detail of the slotted hinge of FIG. 8.

In more detail in FIG. 11, the hinge 30 also includes first and second elongated slots 38, 39 interior of the associated canted members 42, 43. They communicate to the exterior via the passageways 44, 45 previously mentioned so as to permit the enlarged lips 25 of the L-shaped panels 12, 13 to be positioned within the loop members 42, 43, viz., within the slots 38, 39 formed therein.

Note that the passageways 44 and 45 as well as slots 38, 39 aid the user to correctly position the panels 12, 13 during operations to semi-permanently attain one or two positions: (i) a closed position as shown in solid line wherein the lips 25 are positioned within nesting cavity segments 46; and (ii) in a quasi-open sneeze guard position shown in phantom line indicated at 34 in which the lips 25 are positioned within deeper nesting cavity segments 47.

Since the slots 38, 39 are somewhat elliptical in cross section, their associated foci have locational relationships vis-a-vis the positions of the panels 12, 13. When the latter are in either position (i) or (ii), the foci are adjacent to the lips 25 of the panels 12 or 13.

Figure 10:
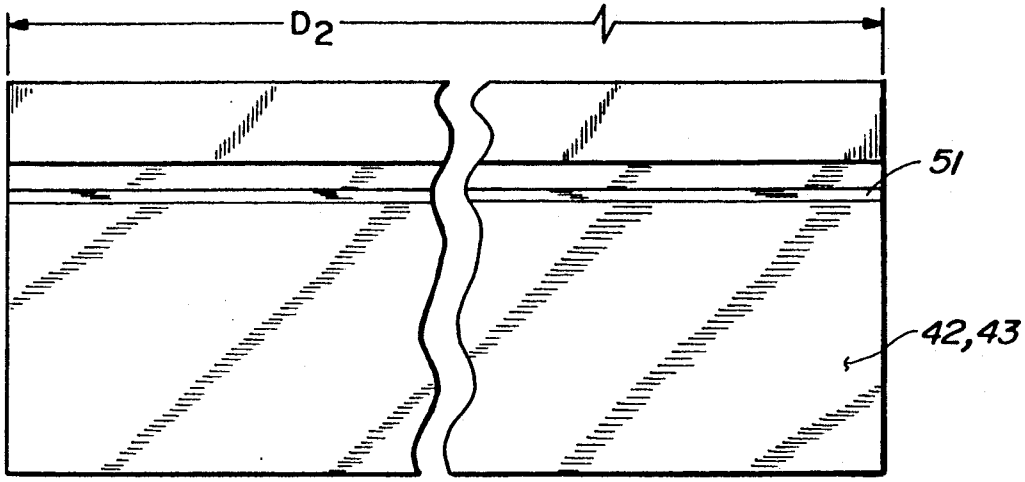
FIGS. 9 and 10 are detailed side and front views, respectively, of one of the two Cee-shaped support members used in the formation of the hinge of FIG. 8.
Figure 9:
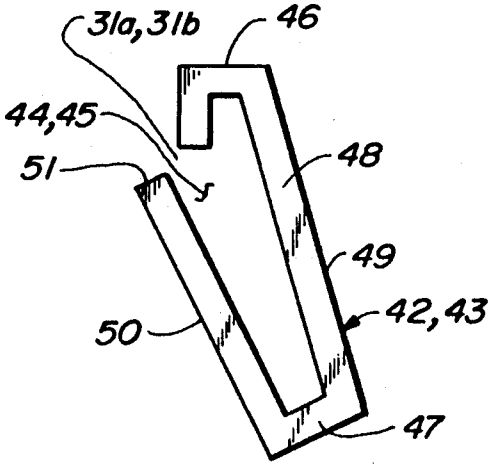

FIGS. 9 and 10 show further constructional details of the support members 42, 43.

As shown, the support members 42, 43 are formed of a series of wall segments that include nesting cavity segments 46, 47 integrally attached via rigid canted side segments 48. Each side segment 48 is seen to have an exterior surface 49. The more flexible segment 50 is cantilevered from the deeper nesting cavity segment 47 and provides an end 51 in contact with broad surface 35 of the L-shaped panels 12 or 13. Such contact point defines the pivot axis 31*a*, 31*b* previously mentioned. Note that the flexible segment 50 is seen to be somewhat parallel to more rigid segment 48 but is not supported along its entire length. Note that the end 51 forms one side of passageway 44 or 45.

Returning to FIG. 11, the pivot axes 31*a*, 31*b* are seen to be separated by distance D3. Yet the front and back panels 12, 13 can be strongly locked in the closed and quasi-open sneeze positions described above. In addition, further rotation away from the table top 15 permits either or both of the front and/or back panels 12, 13 to be released from the hinge 30. In this regard, release usually occurs when either panel 12, 13 nears vertical plane 52.

As shown, the support members 42, 43 previously mentioned are oppositely canted relative to each other in opposite complementary directions. These complementary directions are in the direction of arrows 36, 37 and are defined by complementary skew angles $\theta 1$ and $\theta 2$ between the projections of the flexible wall segments 50 and a common horizontal. The skew angles $\theta 1$ and $\theta 2$ also can be measured as in FIG. 11 between surfaces 35 of the panels 12, 13 when the latter are positioned in their closed and quasi-open positions as shown in solid and phantom line, respectively.

Hence the skew angles $\theta 1$ and $\theta 2$ also define the sneeze guard position of the panels 12, 13 and can have values that range between 50 to 65 degrees with 53 to 57 degrees being preferred. In addition, the more rigid side segments 48 of these members 42, 43 are also seen to be more rigidly held than opposite more flexible cantilevered segments 50. They owe their greater rigidity to (1) the fact that their exterior surfaces 49 is in surface-to-surface contact with a centrally positioned hollow spacer bar 56, (2) the hinge 30 is formed as a segmented assembly of separate elements preferrably of pliant plastics material, and (3) the nesting cavity segments of the support members 42, 43 are in contact with upright keeper skirts 19. An imaginary support volume 57 results. Its width is equal to distance D1 between the keeper skirts 19. Its height is defined by the length L1 of the skirts 19 wherein such length L1 is also in horizontal alignment with portions of the cavity segments 46 and rigid side segments 48 of support members 42, 43, and base 60 of the spacer bar 41. Its depth is equal to the distance D2 of the members 42, 43, see FIGS. 9 and 10.

Figure 13:
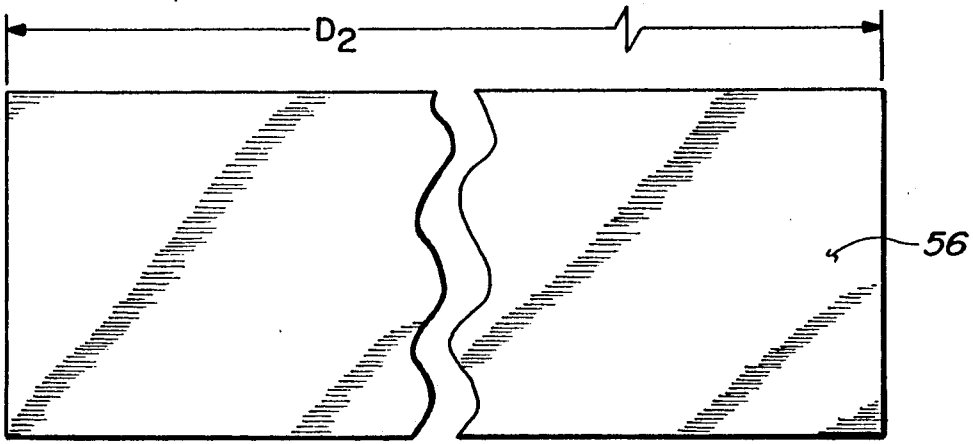
FIGS. 12 and 13 are detailed side and front views, respectively, of a hollow spacer bar also used in the formation of the hinge of FIG. 8.
Figure 12:
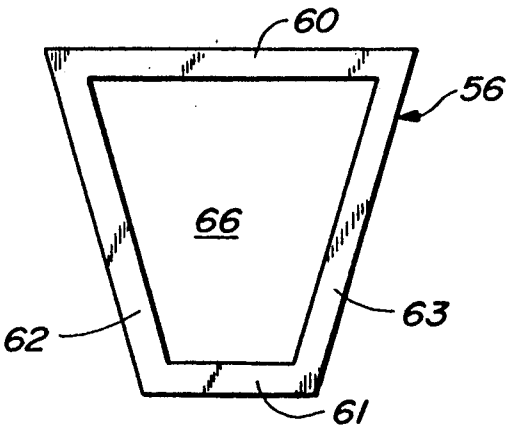

FIGS. 12 and 13 illustrate the spacer bar member 56 in more detail.

As shown, base 60 is wider than truncated top wall 61 and includes oblique side walls 62, 63 forming a parallelepipedon. The base 60, top and side wall 61, 62 and 63 define a hollow interior 66. Note that parallelogram in cross section, results. The length of the bar 41 is equal to that of the members 42, 43 but is slightly less than that of the roof lateral 16, for obvious reasons.

Returning to FIG. 11, after the enlarged lips 25 of the front and back panels 12, 13 are inserted into the slots 38, 39 at the interior of the support members 42, 43, the skirts 19 of the roof lateral 16 are seen to keep the spacer bar 56 and support members 42, 43 in correct working positions. Initially, frictional forces are developed between the nesting cavity segments 46 of the members 42, 43 and the keeper skirts 19, by designing the horizontal extent of the segmented elements comprising the hinge 30 to be slightly greater than the distance D1 between the keeper skirts 17 of the roof lateral 16. The pliant character of the plastic material comprising these elements aids in this regard, although metal materials could be frozen to achieve similar results. These frictional forces must be greater than the magnitude of opposed components of force due to gravity acting on the panels 12, 13.

As shown, the closed position of the front and back panels 12, 13 results in the following positioning of the elements: enlarged lips 25 of the panels 12, 13 are placed in surface-to-surface contact with the nesting cavity segments 46 of support members 42, 43 just below imaginary support volume 57. In addition, the panels 12, 13 are supported via the table top 15 via contact with their edges 14. Hence, components due to gravity that must be opposed by the frictional forces are rather small.

This is not true when the quasi-open sneeze guard position is attained. The frictional forces must be large to overcome the full cantilevered weight of the quasi-opened panel 12 and/or 13. The latter position is obtained as follows after the front and back panels 12, 13 have been pivoted upwardly to the correct sneeze angle (equal to the skew angles $\theta 1$ and $\theta 2$). First, the enlarged lips 25 of these panels 12, 13 are displaced from their positions in contact with the nesting cavity segments 46. Next, they are pivoted about the pivot axes 31*a* or 31*b*. Then, they are caused to undergo rectilinear movement while the skew angles $\theta 1$ and $\theta 2$ are maintained. Such movements are in downward directions opposite to arrows 36, 37 along the interior surfaces 65 of the cantilevered wall segments 50. Such rectilinear movement terminates when the enlarged lips 25 make snug contact with the nesting cavity wall segments 47 of the members 42, 43. Such area of contact is furthest away from the roof lateral 16. But the weight of the panels 12, 13 is greatest.

In order to overcome the effects of such weight, the present invention increases the frictional forces via transference. Note that the weight of the panels 12, 13 acts through support lines at end 51 of the cantilevered wall segment 58 that are colinear and coextensive of the pivot axes 31*a*, 31*b*. As the weight along the support lines increase (as the front and back panels 12, 13 are pivoted and lifted from the table top 15 of FIG. 8), there is downward loading of the cantilevered segments 50. As a result, a component of force is generated and transfered via rigid wall segment 48 and thence to the contact surface between the keeper skirts 19 and the nesting cavity wall segments 46. Hence the present invention provides a surprisinly large increase in the friction forces acting between the hinge 30 and the roof lateral 16, as the quasi-open sneeze guard position is being attained as well as when such position is being maintained.

METHOD ASPECTS

Assembly at the use site includes positioning elements of the hinge 30 in close proximity of the user. Such elements include the spacer bar member 56 of the same length as the first second support members 42, 43. The spacer bar member 56 is a parallelepipedon and includes oppositely canted side walls 62, 63. Using hand pressure, support members 42, 43 and spacer bar 56 are inserted between the skirts 19 of the roof lateral 16 integrally attached to the side panels 17.

FIGS. 2 and 3 illustrate that the roof lateral 16 is integrally formed relative to the side panels 17 so that such subassembly is handled as one unit.

After assembly note that the spacer bar 56 is centrally positioned relative to the support members 42, 43 and skirt keepers 19, so canted side walls 62, 63 can snugly contact like oriented wall segments 48 of the support members 42, 43. The result is the segmented hinge 30 of the invention.

Enlarged lips 25 of the front and back panels 12, 13 are inserted via passageways 44, 45 into the interior of the support members 42, 43 to complete assembly. Disassembly is the reverse of the above steps. All assembly steps occur without the need for tools.

Having described a method and apparatus in accordance with the invention in which advantages can be appreciated by those skilled in the art, it also is evident that certain variations are suggested. It is therefore my intent that such variations be within the scope of the invention as set forth in the following claims.

What is claimed is:

1. A food cover for providing closed and quasi-closed sneeze positions relative to a horizontal base, comprising (i) a pair of upright side panels, (ii) front and back panels each having enlarged lip means along a side thereof, (iii) a hinge means disconnectably connecting said front and back panels relative to said side panels, and including first and second support members each Cee-shaped in cross section and comprising a plurality of wall segments and passageway means to permit entry of said enlarged lip means of said front and back panels therein, wherein friction forces are created between said side panels and said support members based upon flexing support of at least one of said front and back panels by at least one of said plurality of wall segments thereby permitting transfer of increased loading to said side panels in surface contact with other wall segments of said hinge means.

2. The food cover of claim 1 in which said Cee-shaped support members are oppositely canted relative to a working plane normal to both the horizontal base used for supporting said food cover and said side panels and define complementary skew angles, and in which said passageway means of said first and second Cee-shaped support members face away from said working plane to more easily accept entry of said front and back panels.

3. The food cover of claim 2 in which said Cee-shaped support members also include opposed first and second nesting cavity segments into which said enlarged lip means is sequentially inserted to provide said closed and quasi-open sneeze positions.

4. The food cover of claim 3 in which said quasi-open sneeze position is defined by said complementary skew angles.

5. The food cover of claim 4 in which a skew angle is between 50 and 65 degrees.

6. The food cover of claim 5 in which a skew angle is between 53 and 57 degrees.

7. The food cover of claim 1 in which increased loading is due to increased loading at colinear support lines coincident with pivot axes substantially parallel to a horizontal base supporting said side panels and said front and back panels, said pivot axes also being normal to said side panels.

8. The food cover of claim 1 in which said side panels include an integrally formed roof lateral extending therebetween into which said segmented hinge means is mounted by hand pressure.

9. The food cover of claim 8 in which said roof lateral includes a pair of skirt keepers extending downwardly therefrom, said skirt keepers being equidistant from said working plane and defining a support volume for said segmented hinge means.

10. The food cover of claim 9 with the addition of a spacer support bar coincident with said working plane in surface contact with and positioned between said Cee-shaped first and second support members.

11. The food cover of claim 3 in which said plurality of said wall segments of each of said first and second Cee-shaped support members include a rigid side segment and a cantilevered, flexible side segment, said rigid side segment being integrally formed between and being interconnected with said first and second nesting cavity segments, said flexible side segment being cantilevered from one of said nesting cavity segments.

12. The food cover of claim 11 further comprising a spacer support bar coincident with said working plane in surface contact with and positioned between said Cee-shaped first and second support members wherein said spacer support bar includes oppositely canted wall segments each in surface contact with said rigid side segment of said first and second support members.

* * * * *